US007845906B2

(12) United States Patent
Spangler et al.

(10) Patent No.: US 7,845,906 B2
(45) Date of Patent: Dec. 7, 2010

(54) DUAL CUT-BACK TRAILING EDGE FOR AIRFOILS

(75) Inventors: Brandon W. Spangler, Vernon, CT (US); Edward F. Pietraszkiewicz, Southington, CT (US)

(73) Assignee: United Technologies Corporation, Hartford, CT (US)

( * ) Notice: Subject to any disclaimer, the term of this patent is extended or adjusted under 35 U.S.C. 154(b) by 595 days.

(21) Appl. No.: 11/657,322

(22) Filed: Jan. 24, 2007

(65) Prior Publication Data

US 2008/0175714 A1 Jul. 24, 2008

(51) Int. Cl.
*F01D 5/18* (2006.01)

(52) U.S. Cl. ..... 416/97 R

(58) Field of Classification Search ..... 416/97 R
See application file for complete search history.

(56) References Cited

U.S. PATENT DOCUMENTS

| | | | | |
|---|---|---|---|---|
| 5,215,431 | A * | 6/1993 | Derrien | 416/97 R |
| 5,458,461 | A * | 10/1995 | Lee et al. | 416/97 R |
| 6,126,397 | A * | 10/2000 | Kvasnak et al. | 416/97 R |
| 6,981,840 | B2 * | 1/2006 | Lee et al. | 416/97 R |
| 7,374,401 | B2 * | 5/2008 | Lee | 416/97 R |
| 2003/0059305 | A1 * | 3/2003 | Bather et al. | 416/97 R |
| 2005/0106022 | A1 * | 5/2005 | MacManus | 416/97 R |
| 2008/0050243 | A1 * | 2/2008 | Liang | 416/97 R |
| 2009/0324385 | A1 | 12/2009 | Liang | |

* cited by examiner

*Primary Examiner*—Richard Edgar
(74) *Attorney, Agent, or Firm*—Bachman & LaPointe, P.C.

(57) ABSTRACT

A cooling system for an airfoil portion of a turbine engine component is provided. The cooling system includes a first cavity dedicated to cooling a trailing edge portion of an airfoil portion and a second cavity dedicated to cooling an aft portion of a pressure side wall.

19 Claims, 4 Drawing Sheets

DUAL CUT-BACK TRAILING EDGE FOR AIRFOILS

BACKGROUND OF THE INVENTION (1) Field of the Invention

The present invention relates to a trailing edge cooling design for an airfoil portion of a turbine engine component.

(2) Prior Art

FIG. 1 illustrates a conventional turbine blade 10 having a single cutback trailing edge. As can be seen from FIG. 1, the airfoil portion 12 of the blade 10 has a cooling scheme which attempts to cool the very trailing edge 14 as well as the aft pressure side of the airfoil portion 12 with the same set of cast features. That is, the cooling air passes through a first row of cross-over holes 18 and a second row of cross-over holes 20 and finally into the cut back slot 23. The cavity 22 between the rows 18 and 20 of cross-over holes is also a source of cooling air for the pressure side of the airfoil portion 12 via one or more rows of cooling film holes 24. The cooling air flowing from the film holes 24 is used to cool the pressure side slot lip 16. The cavity 22 is a difficult area in which to predict internal pressures. It is sensitive to cross-over geometry and the drilling tolerances of the holes 24. Balancing the flow between cooling the very trailing edge 14 of the airfoil portion 12 and the pressure side lip 16 can be very difficult, given the existence of small aerodynamic wedge angles, and the casting tolerances on the cross-over holes 18 and 20.

FIG. 2 illustrates another airfoil portion 12' of a turbine engine blade 10' having a single cutback trailing edge. In this type of turbine engine blade, there are cooling air supply cavities 30 and 32. A plurality of supply cavities 34 are formed in the walls of the airfoil portion 12'. Each supply cavity 34 receives cooling fluid from the root of the airfoil and/or from one of the supply cavities 30 and 32. At least some of the supply cavities 34 cooperate with a series of film cooling holes 36 to create a film of cooling fluid over one of the pressure side 38 and the suction side 40 of the airfoil portion 12'. To cool the trailing edge 14', a trailing edge cutback slot 42 is formed in the airfoil portion 12'. The cutback slot 42 receives cooling fluid from a cavity 44.

SUMMARY OF THE INVENTION

There remains a need for a more effective way to cool the very trailing edge of an airfoil portion of a turbine engine component as well as the pressure side lip.

There is provided herein a cooling system for an airfoil portion of a turbine engine component, which cooling system includes a first cavity dedicated to cooling a trailing edge portion of an airfoil portion and a second cavity dedicated to cooling an aft portion of a pressure side wall of the airfoil portion.

There is also provided a turbine engine component broadly comprising an airfoil portion having a trailing edge, a first cavity adjacent a suction side wall for cooling said trailing edge, and a second cavity adjacent a pressure side wall for cooling an aft portion of the pressure side wall.

Other details of the dual cut-back trailing edge for airfoils, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
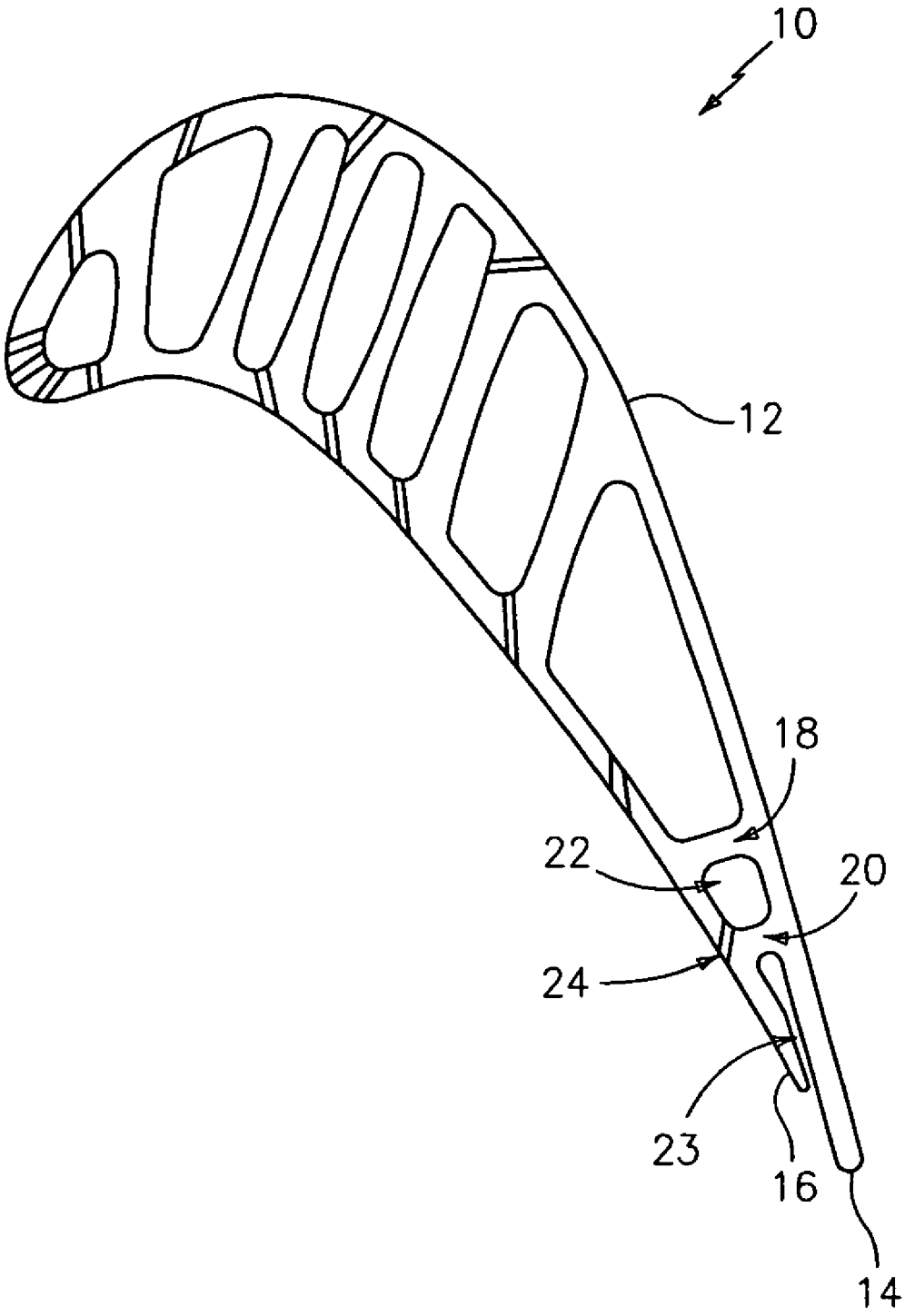
FIG. 1 (PRIOR ART)
FIG. 1 is a schematic representation of a conventional blade having a single cutback trailing edge.
Figure 2:
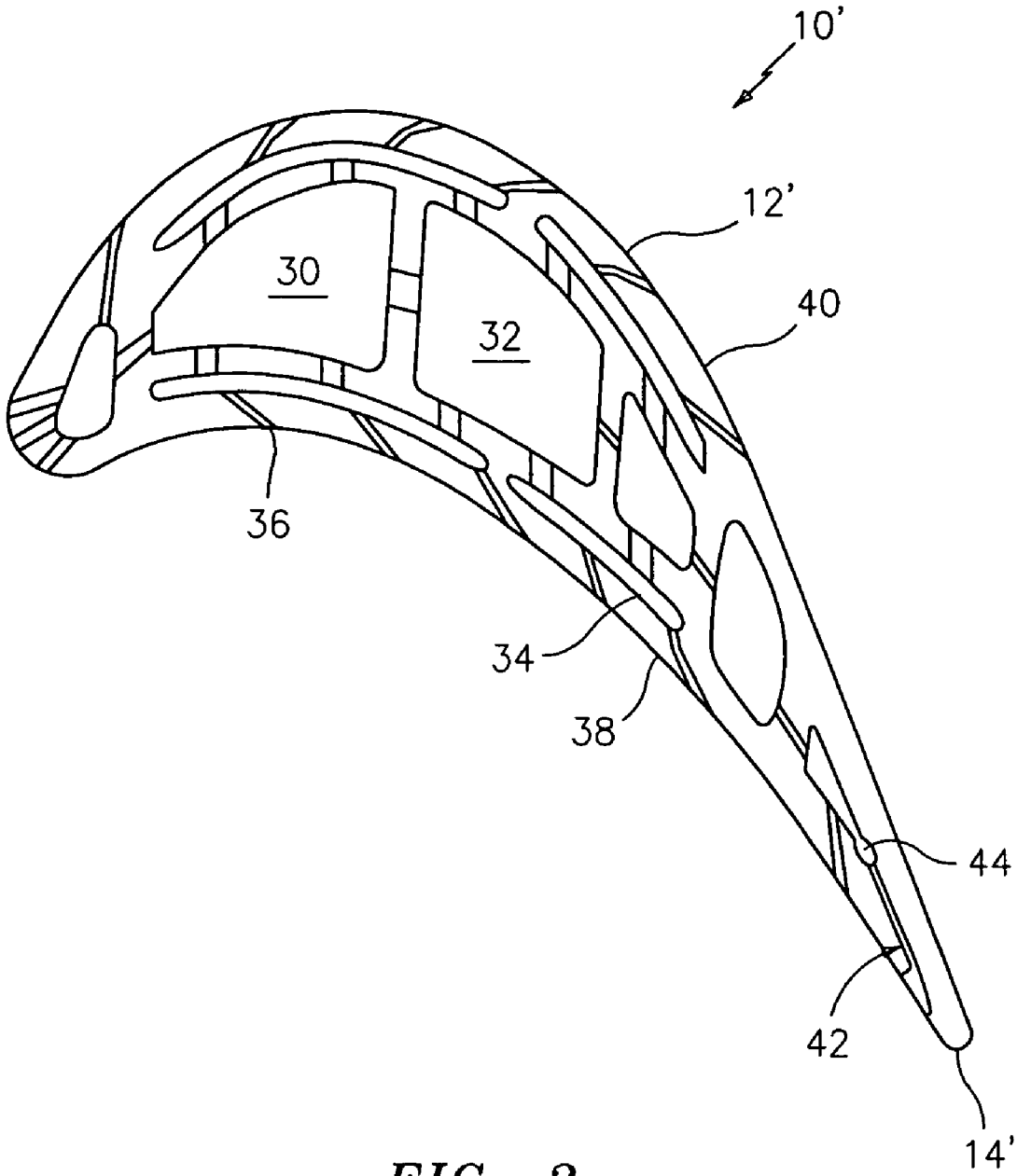
FIG. 2 (PRIOR ART)
FIG. 2 is a schematic representation of an alternative embodiment of a prior art blade having a single cutback trailing edge.
Figure 3:
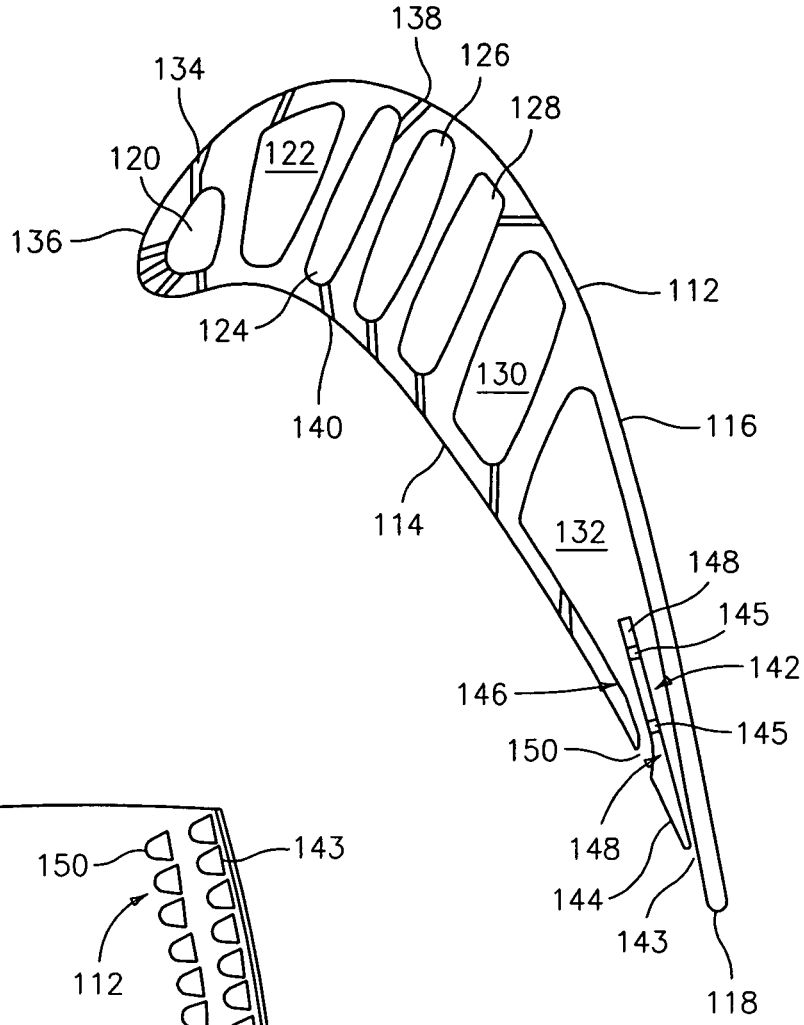
FIG. 3 is a schematic representation of a blade having a dual cutback trailing edge.
Figure 4:
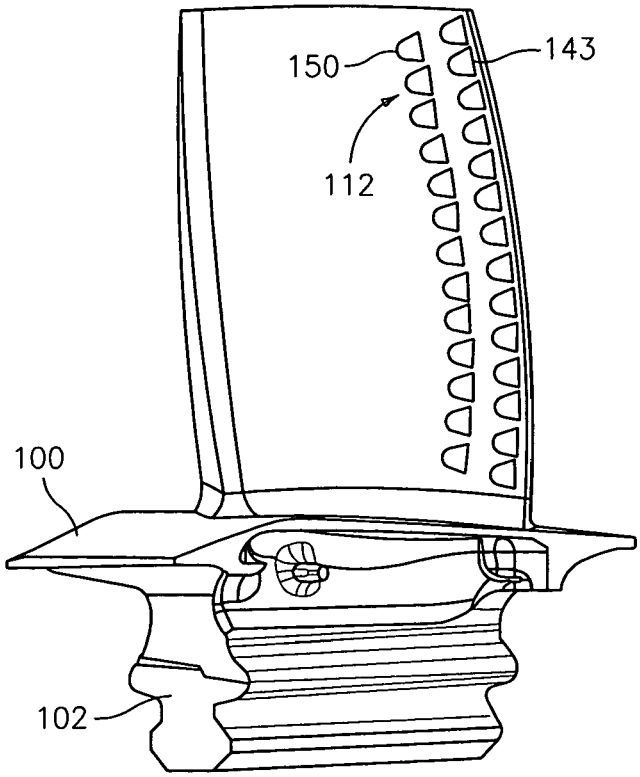
FIG. 4 is a schematic representation of a blade having a staggered slot arrangement as part of the dual cutback trailing edge.

Referring now to the drawings, FIG. 3 illustrates an airfoil portion 112 of a turbine engine component, such as a turbine blade or vane. As shown in FIG. 4, the turbine engine component may have a platform 100 and a root portion 102. The airfoil portion 112 has a pressure side wall 114, a suction side wall 116 and a trailing edge 118. The airfoil portion 112 has a plurality of cooling fluid supply cavities 120, 122, 124, 126, 128, 130, and 132. The supply cavity 120 feeds a plurality of cooling holes 134 for cooling the leading edge 136 of the airfoil portion 112. The supply cavities 122, 124, and 126 feed a plurality of film cooling holes 138 for flowing a film of cooling fluid over the suction side of the airfoil portion 112. The supply cavities 124, 126, 128, 130, and 132 supply cooling fluid to a plurality of film cooling holes 140 for flowing a film of cooling fluid over the pressure side of the airfoil portion 112. While only one row of film cooling holes 134, 138, and 140 have been depicted in FIG. 3, it should be understood that there are actually rows of film cooling holes 134, 138, 140 along the span of the airfoil portion 112.

In order to cool the suction side wall 116 and the trailing edge 118, a first dedicated trailing edge cavity or passageway 142 is fabricated in the airfoil portion 112. The trailing edge cavity 142 is fed with cooling fluid from the supply cavity 132. As shown in FIG. 4, the trailing edge cavity 142 has a plurality of slots 143 through which the cooling fluid exits and flows over the trailing edge.

In order to cool the aft portion 144 of the pressure side wall 114, a second dedicated trailing edge cavity or passageway 146 is fabricated in the airfoil portion 112. The second dedicated trailing edge cavity 146 is separated from the first dedicated trailing edge cavity 142 by a cast wall structure 148. The trailing edge cavity 146 is supplied with cooling fluid from the supply cavity 132. As shown in FIG. 4, the trailing edge cavity 146 has a plurality of slots 150 through which the cooling fluid exits and flows over the aft portion 144 of the pressure side wall 114. To improve the film coverage, the slots 150 may be offset with respect to the slots 143. Further, the row of slots 143 and/or the row of slots 150 may be fanned to conform to the streamlines of the fluid flowing over the airfoil portion 112.

If desired, the first dedicated trailing edge cavity 142 may be in communication with the second dedicated trailing edge cavity 146 via one or more crossover holes 145.

Figure 5:
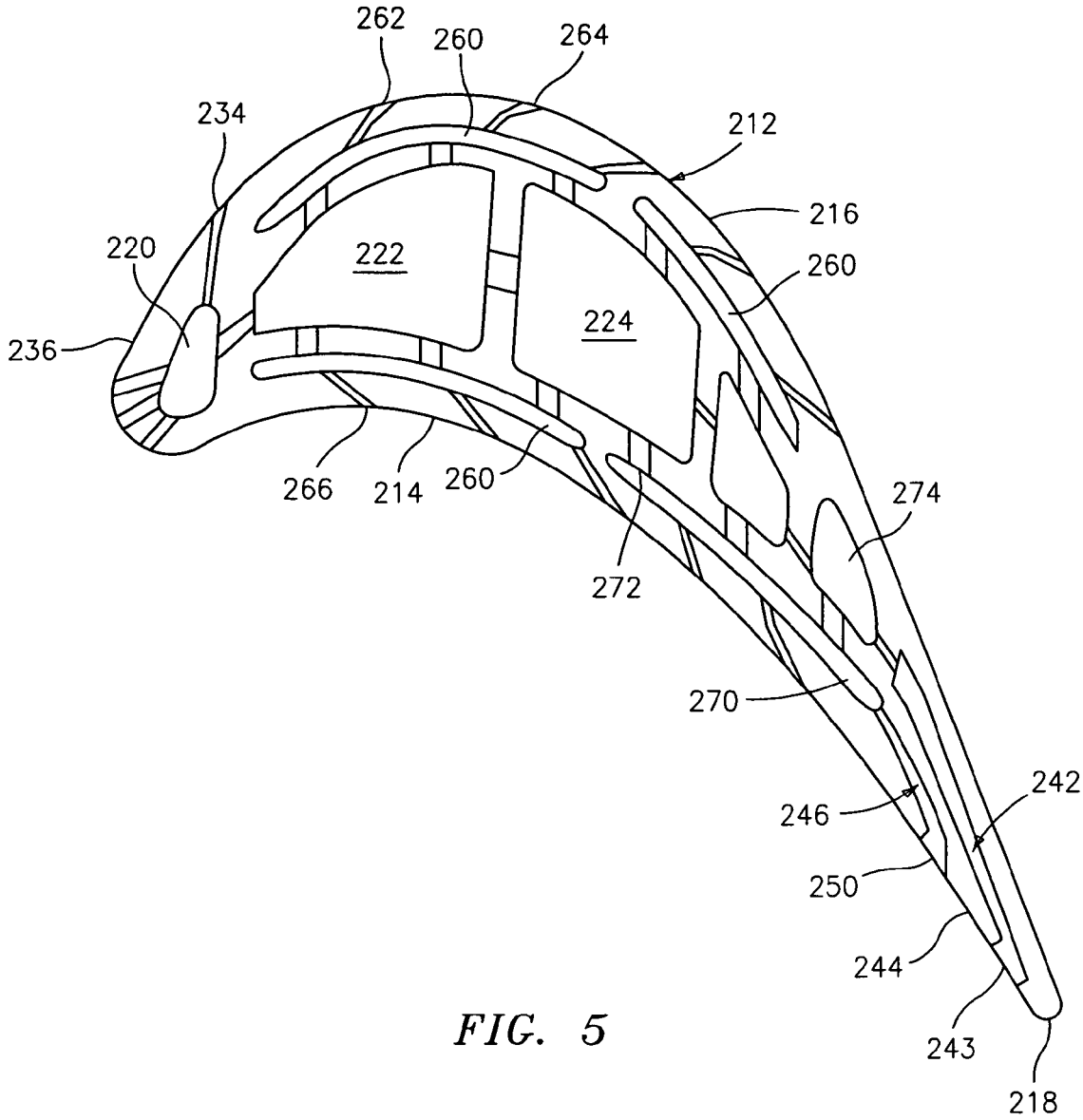
FIG. 5 is a schematic representation of another blade having a dual cutback trailing edge.

FIG. 5 illustrates another blade configuration having an airfoil portion 212 with a pressure side wall 214, a suction side wall 216, and a trailing edge 218. The airfoil portion has a supply cavity 220, a supply cavity 222, and a main supply cavity 224. The supply cavity 220 may be used to supply cooling fluid to one or more leading edge cooling holes 234 for causing cooling fluid to flow over the leading edge 236 of the airfoil portion 212. A plurality of cooling circuits 260 are fabricated into the pressure side wall 214 and the suction side wall 216. The cooling circuits 260 may have any desired configuration and may be fabricated using any suitable technology known in the art. One or more of the cooling circuits 260 embedded within the suction side wall 216 may communicate with one or more film cooling holes 262. A plurality of the cooling circuits 260 embedded within the pressure side wall 214 may communicate with one or more film cooling holes 266. The cooling circuits 260 may be supplied with cooling fluid from the root of the airfoil portion and/or from one of the supply cavities 222 and 224 via passageways. A feed cavity 270 may be fabricated into the pressure side wall 214 and may be supplied with cooling fluid via one or more cross over holes 272.

In order to cool a portion of the suction side wall 216 and the trailing edge 218, a first trailing edge cavity or passageway 242 may be formed in the airfoil portion 212. The trailing edge cavity 242 receives cooling fluid from a supply cavity 274 which is in communication with supply cavity 224. The trailing edge cavity 242 may terminate in a plurality of slots 243 which may be arranged in a row.

In order to cool the aft portion 244 of the pressure side wall 214, a second trailing edge cavity or passageway 246 may be formed in the airfoil portion 212. The second trailing edge cavity receives cooling fluid from the feed cavity 270. The trailing edge cavity 246 may terminate in a plurality of slots 250 which may be configured in a row. As before, the slots 250 and 243 may be offset so as to promote cooling film coverage. Additionally, one or more of rows of slots 243 and 250 may be fanned to conform to the streamlines of the fluid flowing over the airfoil portion 212.

The trailing edge cavities 142, 146, 242, and 246 may be formed using a ceramic core or a refractory metal core or any other suitable manufacturing technology known in the art.

Using the dual cutback trailing edges described herein, cooler trailing edge temperatures may be achieved. Additionally, one may be able to use lower trailing edge wedge angles for better aerodynamic efficiency. Still further, backflow margin issues normally associated with film rows may be minimized. Using the slot arrangement described herein will improve film/cooling effectiveness by increasing coverage.

It is apparent that there has been provided in accordance with the present invention, dual cutback trailing edges which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A cooling system for an airfoil portion of a turbine engine component including:

a first cavity dedicated to cooling a trailing edge portion of said airfoil portion;

a second cavity dedicated to cooling an aft portion of a pressure side wall of said airfoil portion;

said first and second cavities being supplied with cooling fluid from a common supply cavity;

said first cavity having a plurality of first exit slots for allowing cooling fluid to flow over said trailing edge and said second cavity having a plurality of second exit slots for allowing cooling fluid to flow over said pressure side lip portion;

said common supply cavity having at least one cooling hole for allowing cooling fluid to flow over the pressure side wall of said airfoil portion;

said first exit slots being offset from said second exit slots to improve cooling effectiveness; and said first exit slots being arranged in a fanned configuration to conform to fluid streamlines over the pressure side surface of the airfoil portion and said second exit slots being arranged in a fanned configuration to conform to fluid streamlines over the pressure side surface of the airfoil portion.

2. The cooling system of claim 1, wherein said first cavity is positioned adjacent a suction side wall to cool said suction side wall.

3. The cooling system of claim 1, wherein said second cavity is positioned adjacent a pressure side wall of said airfoil portion.

4. The cooling system of claim 1, wherein said first and second cavities are separated by a wall structure.

5. The cooling system of claim 1, wherein said first exit slots are arranged in a first row and said second exit slots are arranged in a second row.

6. A cooling system for an airfoil portion of a turbine engine component including:

a first cavity dedicated to cooling a trailing edge portion of said airfoil portion;

a second cavity dedicated to cooling an aft portion of a pressure side wall of said airfoil portion;

said first and second cavities being supplied with cooling fluid from a common supply cavity;

said first cavity having a plurality of first exit slots for allowing cooling fluid to flow over said trailing edge and said second cavity having a plurality of second exit slots for allowing cooling fluid to flow over said pressure side lip portion; and said first exit slots being offset from said second exit slots to improve cooling effectiveness, wherein said first exit slots are arranged in a fanned configuration to conform to fluid streamlines over the pressure side surface of the airfoil portion and wherein said second exit slots are arranged in a fanned configuration to conform to fluid streamlines over the pressure side surface, and wherein said first cavity is supplied with cooling fluid from a first feed cavity in a trailing edge portion of said airfoil portion, which feed cavity receives fluid from said common supply cavity.

7. The cooling system of claim 6, wherein said second cavity is supplied with cooling fluid from a second feed cavity embedded within said pressure side wall, which second feed cavity receives fluid from said common supply cavity.

8. A cooling system of for an airfoil portion of a turbine engine component including:

a first cavity dedicated to cooling a trailing edge portion of said airfoil portion;

a second cavity dedicated to cooling an aft portion of a pressure side wall of said airfoil portion;

said first cavity having a plurality of first exit slots for allowing cooling fluid to flow over said trailing edge and said second cavity having a plurality of second exit slots for allowing cooling fluid to flow over said pressure side lip portion;

said first exit slots being offset from said second exit slots to improve cooling effectiveness;

said first exit slots being arranged in a fanned configuration to conform to fluid streamlines over the pressure side surface of the airfoil portion and said second exits slots being arranged in a fanned configuration to conform to fluid streamlines over the pressure side of the airfoil portion; and said first cavity and said second cavity communicating with each other via crossover holes.

9. The cooling system of claim 8, wherein said first and second cavities are supplied with cooling fluid from a common supply cavity.

10. A turbine engine component which comprises:

an airfoil portion having a trailing edge, a suction side wall, and a pressure side wall;

a first cavity adjacent said suction side wall for cooling said trailing edge;

a second cavity adjacent said pressure side wall for cooling an aft portion of said pressure side wall;

said first and second cavities being supplied with cooling fluid from a common supply cavity;

said common supply cavity having at least one hole for allowing cooling fluid to flow over said pressure side wall;

said first cavity having a plurality of first exit slots for allowing cooling fluid to flow over said trailing edge and said second cavity having a plurality of second exit slots for allowing cooling fluid to flow over said pressure side lip portion;

said first exit slots being arranged in a fanned configuration to conform to fluid streamlines over the pressure side surface of the airfoil portion and said second exit slots being arranged in a fanned configuration to conform to fluid streamlines over the pressure side surface of the airfoil portion; and said first exit slots being offset from said second exit slots to improve cooling effectiveness.

11. The turbine engine component of claim 10, wherein said first cavity cools said suction side wall.

12. The turbine engine component of claim 10, wherein said first and second cavities are separated by a wall structure.

13. The turbine engine component of claim 10, wherein said first exit slots are arranged in a first row and said second exit slots are arranged in a second row.

14. The turbine engine component of claim 10, wherein said component is a turbine blade.

15. The turbine engine component of claim 10, wherein said component is a vane.

16. The turbine engine component of claim 10, further comprising a platform and a root portion.

17. The turbine engine component of claim 10, further comprising means for cooling a leading edge of said airfoil portion.

18. The turbine engine component of claim 10, further comprising means for creating a cooling film over said suction side wall.

19. The turbine engine component of claim 10, further comprising additional means for creating a cooling film over said pressure side wall.

* * * * *